US009458562B2

(12) United States Patent
Kawaguchi et al.

(10) Patent No.: US 9,458,562 B2
(45) Date of Patent: Oct. 4, 2016

(54) SEWING MACHINE

(71) Applicants: Yasuhiko Kawaguchi, Nagoya (JP); Takahira Osamura, Kitanagoya (JP)

(72) Inventors: Yasuhiko Kawaguchi, Nagoya (JP); Takahira Osamura, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 299 days.

(21) Appl. No.: 14/199,012

(22) Filed: Mar. 6, 2014

(65) Prior Publication Data

US 2014/0283720 A1 Sep. 25, 2014

(30) Foreign Application Priority Data

Mar. 21, 2013 (JP) ..... 2013-057951

(51) Int. Cl.
*D05B 19/16* (2006.01)
*D05B 39/00* (2006.01)
*D05C 9/04* (2006.01)

(52) U.S. Cl.
CPC ..... *D05B 19/16* (2013.01); *D05B 39/00* (2013.01); *D05C 9/04* (2013.01)

(58) Field of Classification Search
CPC ..... D04B 19/02; D04B 19/04; D04B 19/08; D04B 19/10; D04B 19/16; D04B 39/00; D04B 21/00
See application file for complete search history.

(56) References Cited

U.S. PATENT DOCUMENTS

| | | | |
|---|---|---|---|
| 478,192 | A | 7/1892 | Hurzeler |
| 3,164,112 | A | 1/1965 | Bono |
| 4,590,695 | A | 5/1986 | McGillivray |
| 4,763,586 | A | 8/1988 | Takenoya et al. |
| 4,989,525 | A | 2/1991 | Portilla |
| 5,551,112 | A | 9/1996 | Brandsma et al. |
| 5,584,799 | A | 12/1996 | Gray |
| 5,855,176 | A | 1/1999 | Takenoya et al. |
| 6,161,491 | A | 12/2000 | Takenoya et al. |
| 6,336,416 | B1 | 1/2002 | French et al. |
| 6,684,799 | B2 | 2/2004 | Ninomiya et al. |

(Continued)

FOREIGN PATENT DOCUMENTS

| | | |
|---|---|---|
| EP | 1 270 788 A1 | 1/2003 |
| EP | 2 484 827 A1 | 8/2012 |

(Continued)

OTHER PUBLICATIONS

Jan. 15, 2015 Office Action issued in U.S. Appl. No. 14/199,014.

(Continued)

*Primary Examiner* — Danny Worrell
(74) *Attorney, Agent, or Firm* — Oliff PLC

(57) ABSTRACT

A sewing machine includes a frame support portion, a moving device, a movable member and a detecting device. The frame support portion is configured to be detachably mounted with a mounting portion of an embroidery frame. The mounting portion has a specific shape that corresponds to a type of the embroidery frame. The moving device is configured to move the frame support portion. The movable member is configured to move in a first direction by a movement amount corresponding to the type of the embroidery frame, in conjunction with an operation in which the mounting portion of the embroidery frame is mounted on the frame support portion. The detecting device configured to detect the movement amount of the movable member, and to detect the type of the embroidery frame mounted on the frame support portion based on the detected movement amount.

3 Claims, 13 Drawing Sheets

(56) References Cited

U.S. PATENT DOCUMENTS

| | | | | |
|---|---|---|---|---|
| 6,820,565 | B1 * | 11/2004 | Kawaguchi | D05B 21/00 112/102.5 |
| 7,178,256 | B2 | 2/2007 | Roche | |
| 7,258,071 | B2 | 8/2007 | Shoji | |
| 7,854,207 | B2 | 12/2010 | Kuki et al. | |
| 8,028,633 | B2 | 10/2011 | Naka et al. | |
| 2002/0195034 | A1 * | 12/2002 | Stucki | D05B 21/00 112/102.5 |
| 2004/0221780 | A1 | 11/2004 | Kawaguchi et al. | |
| 2015/0000574 | A1 | 1/2015 | Kawaguchi et al. | |

FOREIGN PATENT DOCUMENTS

| | | |
|---|---|---|
| JP | A-5-192466 | 8/1993 |
| JP | A-2004-254987 | 9/2004 |

OTHER PUBLICATIONS

Oct. 21, 2014 Extended European Search Report issued in Application No. 14159304.6.

Extended European Search Report issued in European Application No. 14159307.9 issued Jun. 25, 2014.

Partial European Search Report issued in European Application No. 14159304.6 issued Jun. 25, 2014.

Pending U.S. Appl. No. 14/199,014, filed Mar. 6, 2014.

Jul. 7, 2015 Office Action issued in European Application No. 14 159 307.9.

* cited by examiner

| ANGLE (DEGREE) | SIZE | ANGLE C (DEGREE) | POSITION |
|---|---|---|---|
| NOT LESS THAN B1 AND LESS THAN B2 | L1, L2 | 45 | (X1, Y1) |
| NOT LESS THAN B2 AND LESS THAN B3 | L1, L2 | 0 | (X1, Y1) |
| NOT LESS THAN B3 | L1, L2 | -45 | (X1, Y1) |

SEWING MACHINE

CROSS-REFERENCE TO RELATED APPLICATION

This application claims priority to Japanese Patent Application No. 2013-57951 filed Mar. 21, 2013, the content of which is hereby incorporated herein by reference in its entirety.

BACKGROUND

The present disclosure relates to a sewing machine on which an embroidery frame can be mounted.

A sewing machine that is capable of embroidery sewing performs embroidery sewing while relatively moving a needle and a sewing workpiece that is held by an embroidery frame, based on embroidery data that specifies coordinates of needle drop points. With a sewing machine that can mount a selected one of a plurality of types of embroidery frames, it is necessary for the sewing machine to detect the type of the embroidery frame that is mounted on the sewing machine, in order to set a sewing area on the inside of the embroidery frame. To address this, for example, a known sewing machine identifies the type of the embroidery frame by detecting a portion to be detected of an object to be detected that is arranged in a position corresponding to the type of the embroidery frame.

SUMMARY

With the above-described sewing machine, in order to arrange the object to be detected in the position corresponding to the type of the embroidery frame, it is necessary for a user to manually move a movable holder, on which is mounted the object to be detected, to the position corresponding to the type of the embroidery frame. Every time the user changes the type of the embroidery frame, the user has to change the position of the movable holder. As a result, the operation to mount the embroidery frame holding the sewing workpiece onto the sewing machine is complicated.

Embodiments of the broad principles derived herein provide a sewing machine that can detect a type of an embroidery frame and that can also simplify an operation to mount the embroidery frame.

Embodiments provide a sewing machine that includes a frame support portion, a moving device, a movable member and a detecting device. The frame support portion is configured to be detachably mounted with a mounting portion of an embroidery frame. The embroidery frame is configured to hold a sewing workpiece. The mounting portion has a specific shape that corresponds to a type of the embroidery frame. The moving device is configured to move the frame support portion. The movable member is configured to move in a first direction by a movement amount corresponding to the type of the embroidery frame, in conjunction with an operation in which the mounting portion of the embroidery frame is mounted on the frame support portion. The detecting device configured to detect the movement amount of the movable member, and to detect the type of the embroidery frame mounted on the frame support portion based on the detected movement amount.

Embodiments further provide a sewing machine that includes an embroidery frame, a frame support portion, a moving device, a movable member and a detecting device. The embroidery frame is configured to hold a sewing workpiece. The embroidery frame has a specific mounting portion that corresponds to a type of the embroidery frame. The frame support portion is configured to be detachably mounted with the mounting portion. The moving device is configured to move the frame support portion. The movable member configured to move in a first direction by a movement amount corresponding to the type of the embroidery frame, in conjunction with an operation in which the mounting portion of the embroidery frame is mounted on the frame support portion. The detecting device is configured to detect the movement amount of the movable member, and to detect the type of the embroidery frame mounted on the frame support portion based on the detected movement amount.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. A configuration of a multi-needle sewing machine (hereinafter simply referred to as a sewing machine) 1 according to the embodiment will be explained with reference to FIGS. 1 to 9. In the explanation below, the upper side, the lower side, the lower left side, the upper right side, the upper left side and the lower right side of FIG. 1 respectively correspond to the upper side, the lower side, the front side, the back side, the left side and the right side of the sewing machine 1.

Figure 1:
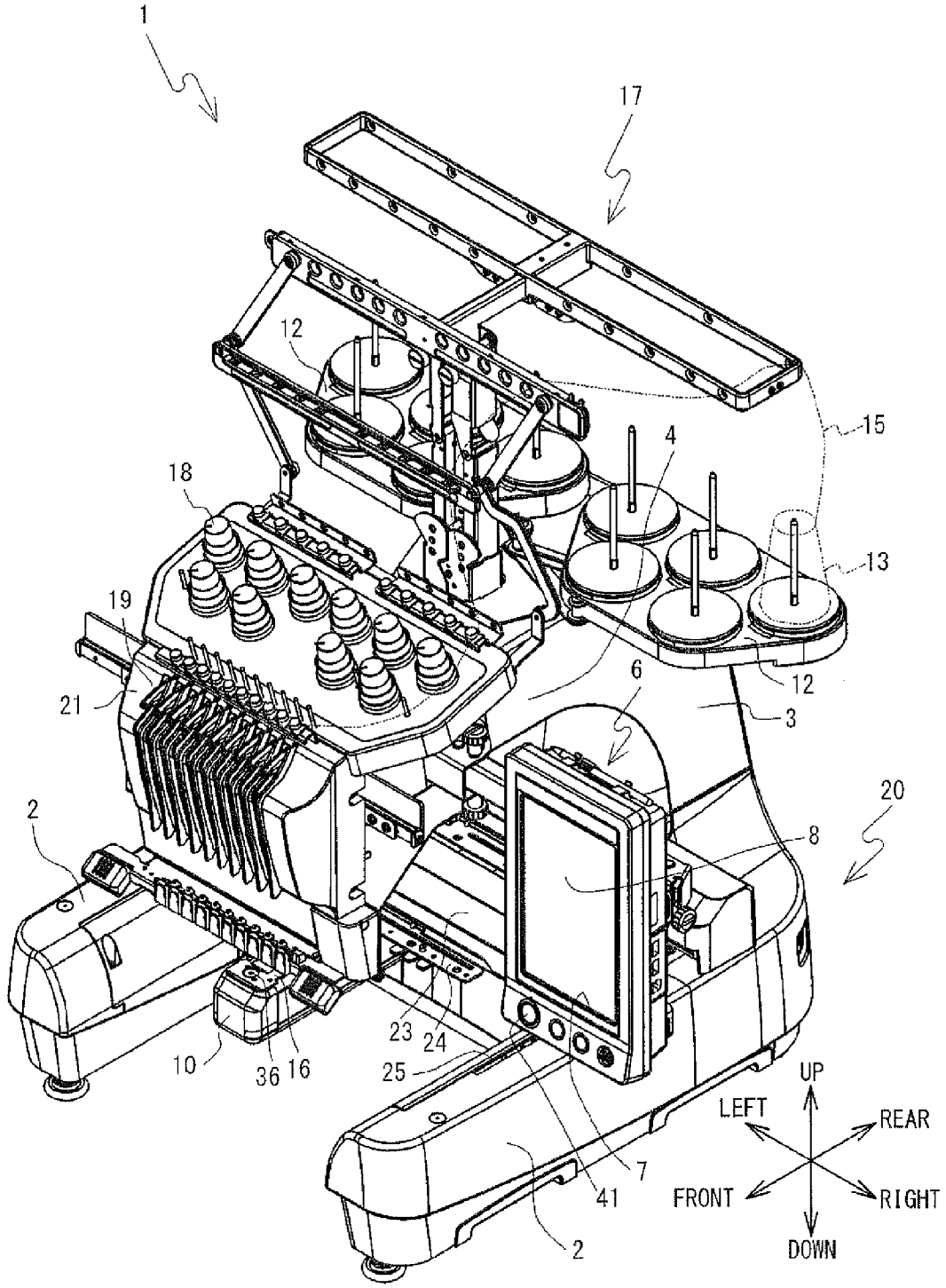
FIG. 1 is a perspective view of a multi-needle sewing machine 1.

As shown in FIG. 1, a main body 20 of the sewing machine 1 is mainly provided with a pair of left and right support portions 2, a pillar 3 and an arm portion 4. The pair of left and right support portions 2 are formed in an inverted U-shape as a whole in a plan view, and supports the whole of the sewing machine 1. A pair of left and right guide grooves 25, which extend in a front-rear direction, are provided in an upper surface of the pair of support portions 2. The pillar 3 is provided so as to extend upward from a rear end portion of the pair of support portions 2. The arm portion 4 extends to the front from an upper end portion of the pillar 3. A needle bar case 21 is attached to the tip end of the arm portion 4 such that the needle bar case 21 can move in a left-right direction. Ten needle bars 31 (refer to FIG. 13), which extend in an up-down direction, are disposed inside the needle bar case 21 at an equal interval in the left-right direction. Of the ten needle bars 31, the needle bar 31 that is in a sewing position is caused to move in the up-down direction by a needle bar drive mechanism 32 (refer to FIG. 13) that is provided inside the needle bar case 21. A needle (not shown in the drawings) is detachably attached to the lower end of each of the needle bars 31.

An operation portion 6 is provided on the right side of a central portion in the front-rear direction of the arm portion 4. The operation portion 6 is provided with a liquid crystal display (LCD) 7, a touch panel 8 and a start/stop switch 41. The LCD 7 may display various types of information, such as operation images used by a user to input a command, for example. The touch panel 8 may be used to receive a command from the user. The user can select or set various types of conditions, such as a sewing pattern and a sewing condition, by performing a pressing operation (this operation is hereinafter referred to as a "panel operation"), using a finger or a stylus pen, on sections of the touch panel 8 that correspond to positions of input keys etc. displayed on the LCD 7. The start/stop switch 41 is a switch that may be used to issue a command to start or stop sewing.

A cylinder-shaped cylinder bed 10, which extends to the front from a lower end portion of the pillar 3, is provided below the arm portion 4. A shuttle (not shown in the drawings) is provided inside a leading end portion of the cylinder bed 10. The shuttle houses a bobbin (not shown in the drawings) on which a bobbin thread (not shown in the drawings) is wound. A shuttle drive mechanism (not shown in the drawings) is provided inside the cylinder bed 10. The shuttle drive mechanism is configured to rotatably drive the shuttle. A needle plate 16, having a rectangular shape in a plan view, is provided on an upper surface of the cylinder bed 10. The needle plate 16 is provided with a needle hole 36 through which the needle (not shown in the drawings) passes.

A pair of left and right thread spool bases 12 are provided on a back surface side of an upper surface of the arm portion 4. The number of thread spools 13 that can be mounted on the pair of the thread spool bases 12 is ten, which is the same as the number of the needle bars 31. A needle thread 15 is supplied from one of the thread spools 13 mounted on the thread spool bases 12. The needle thread 15 is supplied, via a thread guide 17, a tensioner 18, a thread take-up lever 19 and the like, to an eye (not shown in the drawings) of each of the needles attached to the lower end of each of the needle bars 31.

A Y carriage 23 of an embroidery frame movement mechanism 11 (refer to FIG. 13) is supported below the arm portion 4 such that the Y carriage 23 can move in the front-rear direction (Y direction) of the sewing machine 1. The Y carriage 23 extends in the left-right direction, and supports an X carriage 26 (refer to FIG. 2) inside the Y carriage 23 such that the X carriage 26 can move in the left-right direction (X direction) of the sewing machine 1. A holder 24 that is configured to be mounted with an embroidery frame 5 may be attached to the X carriage 26. The embroidery frame movement mechanism 11 is configured to cause the X carriage 26 to move in the left-right direction using an X-axis motor 132 (refer to FIG. 13) as a driving source, and to cause the Y carriage 23 to move in the front-rear direction using a Y axis motor 134 (refer to FIG. 13) as a driving source. With this configuration, the embroidery frame movement mechanism 11 is configured to move the embroidery frame 5, which is mounted on the sewing machine 1 via the holder 24, to a needle drop point that is indicated by an embroidery coordinate system that is specific to the sewing machine 1. The embroidery coordinate system is a coordinate system of the X-axis motor 132 and the Y-axis motor 134 that move the X carriage 26. In the present embodiment, the embroidery coordinate system is defined as follows. The left-right direction of the sewing machine 1 is the X direction, and the direction from the left to the right is an X axis plus direction. The front-rear direction of the sewing machine 1 is the Y direction, and the direction from the front to the rear is a Y axis plus direction.

The embroidery frame 5 will be explained with reference to FIGS. 2 to 5. The embroidery frame 5 is configured to hold the sewing workpiece. A selected one of three types of the embroidery frames 5 can be mounted on the sewing machine 1 of the present embodiment. The three types of the embroidery frames 5 are an embroidery frame 84 shown in FIGS. 2 and 3, an embroidery frame 184 shown in FIG. 4, and an embroidery frame 284 shown in FIG. 5. In the present embodiment, when the embroidery frames 84, 184 and 284 are collectively referred to, they are referred to as the embroidery frames 5. When any one of the embroidery frames 84, 184 and 284 is referred to without being particularly identified, it is referred to as an embroidery frame 5. In the present embodiment, the three types of the embroidery frames 5 are provided with a common holding portion 83. The three types of the embroidery frames 5 are different from each other in the angle in the long side direction of the holding portion 83 with respect to a frame support portion 58 that will be described later. The structure of the embroidery frame 5 in a state in which the embroidery frame 5 is mounted on the sewing machine 1 will be explained in the order of the embroidery frames 84, 184 and 284.

Figure 2:
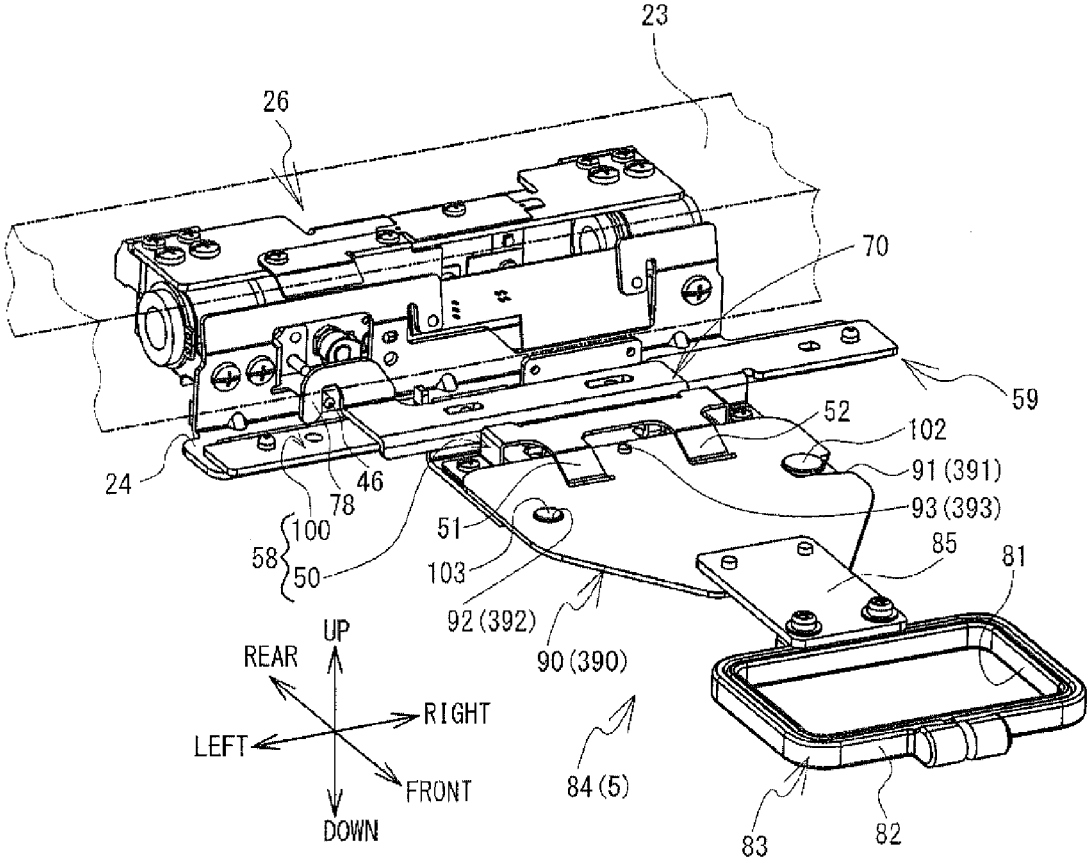
FIG. 2 is a perspective view of an embroidery frame 84 and a frame mounting mechanism 59 on which the embroidery frame 84 is mounted.
Figure 3:
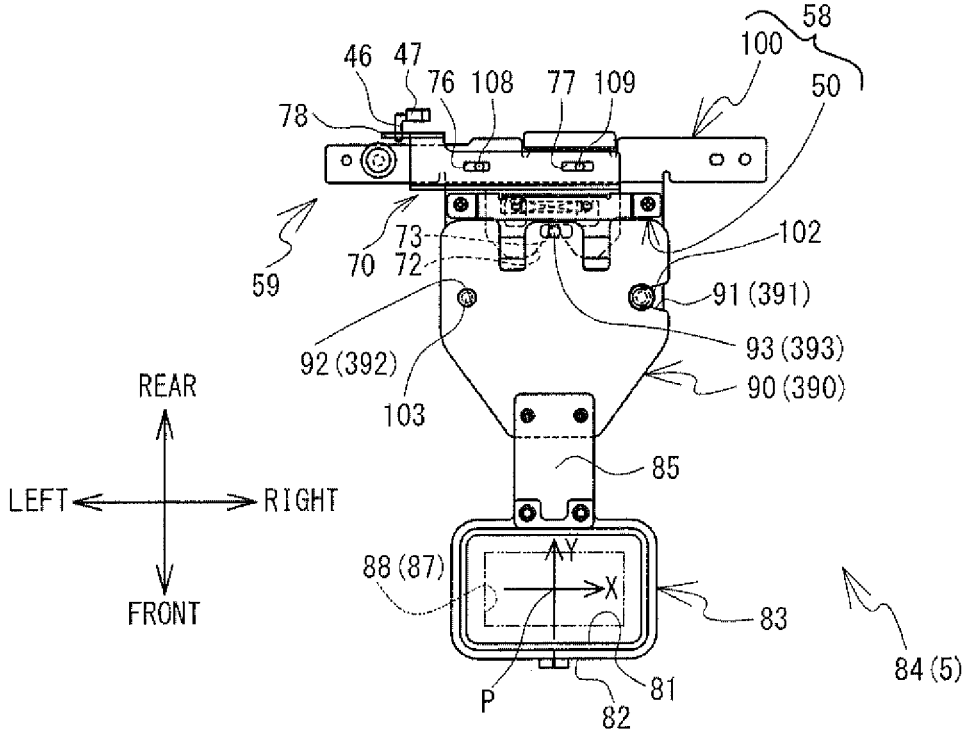
FIG. 3 is a plan view of the embroidery frame 84 that can be mounted on the multi-needle sewing machine 1.

As shown in FIGS. 2 and 3, the embroidery frame 84 mainly includes the holding portion 83, a connecting portion 85 and a mounting portion 90. The holding portion 83 includes an inner frame 81 and an outer frame 82 each having are a rounded rectangular shape in a plan view. The inner periphery of the outer frame 82 has substantially the same shape as the outer periphery of the inner frame 81, and the inner frame 81 is configured to be detachably fitted to the inner side of the outer frame 82. A divided portion that is divided is provided in a central portion of the outer frame 82 in the long side direction. The divided portion is provided with a fastening mechanism that is configured to fasten the outer frame 82 to the inner frame 81. The sewing workpiece may be clamped between the inner frame 81 and the outer frame 82, and may be held such that the sewing workpiece is tightly stretched by the fastening mechanism. A user can change a holding position of the sewing workpiece with respect to the embroidery frame 84 by changing a part of the sewing workpiece that is clamped by the holding portion 83.

The connecting portion 85 is a metal plate member having a rectangular shape in a plan view, and connects the central portion of one of the long sides of the outer frame 82 and a front central portion of the mounting portion 90. The mounting portion 90 is a metal plate member, and may be used to mount the embroidery frame 84 on the frame mounting mechanism 59 of the sewing machine 1. The mounting portion 90 has a specific structure corresponding to the type of the embroidery frame 84. More specifically, the mounting portion 90 is a hexagonal plate member that extends in the horizontal direction. One of the six sides that is on the rear side of the mounting portion 90 and one of the six sides that is on the front side of the mounting portion 90 each extend in the left-right direction. The mounting portion 90 is provided with an engagement portion 91, a through hole 92 and a pressing portion 93. The engagement portion 91 is a cutout that is provided in a central portion of the right side (that extends in the front-rear direction) of the mounting portion 90, and is configured to be engaged with an engagement portion 102 of a main body 100 that will be described later. The through hole 92 is a circular hole that is provided in a central portion on the left side of the mounting portion 90, and is configured to be engaged with an engagement portion 103 of the main body 100. The pressing portion 93 has a pin shape that protrudes downward. The position of the pressing portion 93 with respect to the engagement portion 91 is set to a position that is specific to the embroidery frame 84 in order to distinguish between the embroidery frame 84 and the other embroidery frames 5.

In a state in which the embroidery frame 84 is mounted on the sewing machine 1, the inclination of the holding portion 83 in the long side direction with respect to the extension direction of the frame support portion 58 (hereinafter referred to as the "inclination of the holding portion 83") is 0 degrees. The extension direction of the frame support portion 58 of the present embodiment is the left-right direction. In the present embodiment, the inclination with respect to the extension direction of the frame support portion 58 is defined such that an angle in the clockwise direction with respect to the extension direction of the frame support portion 58 is a plus angle and an angle in the counterclockwise direction with respect to the extension direction of the frame support portion 58 is a minus angle. The extension direction of the frame support portion 58 is the same as the extension direction of the Y carriage 23 and the X carriage 26. The extension direction of the frame support portion 58 is the same as the direction in which the X carriage 26 is moved by the X-axis motor 132 (refer to FIG. 13) as a driving source.

Figure 4:
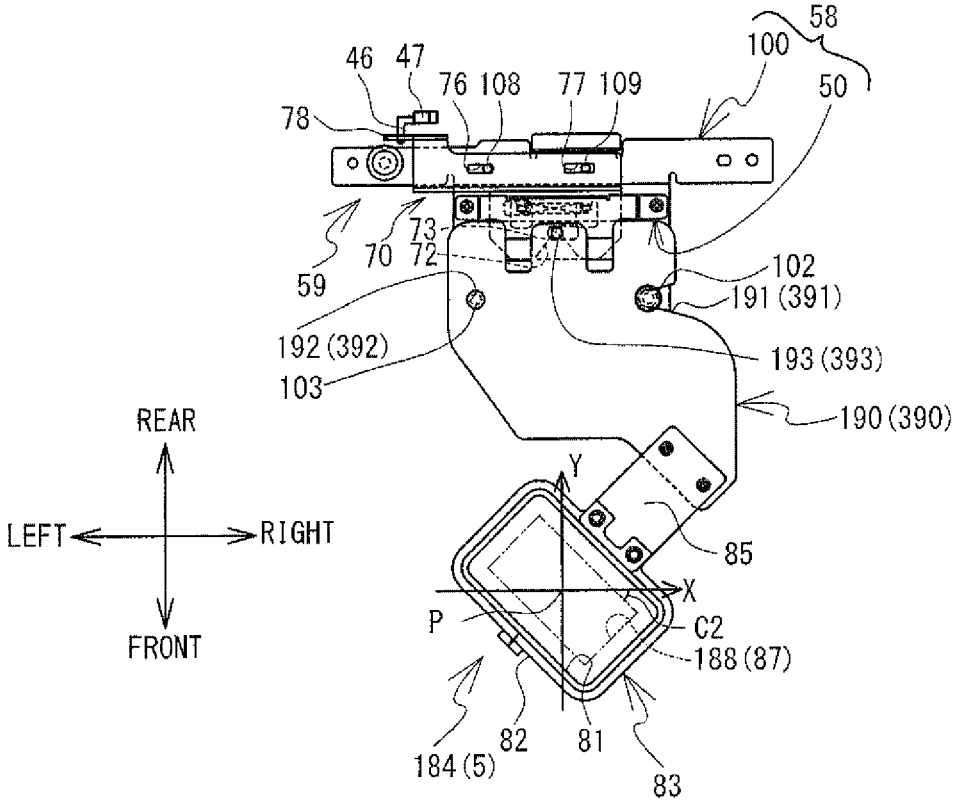
FIG. 4 is a plan view of an embroidery frame 184 that can be mounted on the multi-needle sewing machine 1.

The inclination (an angle C2) of the holding portion 83 of the embroidery frame 184 shown in FIG. 4 is 45 degrees. The embroidery frame 184 has the holding portion 83, the connecting portion 85 and a mounting portion 190. The holding portion 83 and the connecting portion 85 of the embroidery frame 184 are the same as the holding portion 83 and the connecting portion 85 of the embroidery frame 84. The mounting portion 190 is a plate member that extends in the horizontal direction. The shape of the mounting portion 190 is different from the shape of the mounting portion 90 and also different from the shape of a mounting portion 290. The mounting portion 190 is formed such that a right front portion of the mounting portion 190 protrudes further toward the front than a right front portion of the mounting portion 90. The connecting portion 85 connects the central portion of the one of the long sides of the outer frame 82 and the right front portion of the mounting portion 190, and the inclination of the holding portion 83 is set to 45 degrees. The mounting portion 190 is provided with an engagement portion 191, a through hole 192 and a pressing portion 193. The engagement portion 191 is a cutout that is provided in a central portion of the right side (that extends in the front-rear direction) of the mounting portion 190, and is configured to be engaged with the engagement portion 102 of the main body 100 that will be described later. The through hole 192 is a circular hole that is provided in a central portion on the left side of the mounting portion 190, and is configured to be engaged with the engagement portion 103 of the main body 100. The pressing portion 193 has a pin shape that protrudes downward. The position of the pressing portion 193 with respect to the engagement portion 191 is set to a position that is specific to the embroidery frame 184 in order to distinguish between the embroidery frame 184 and the other embroidery frames 5.

Figure 5:
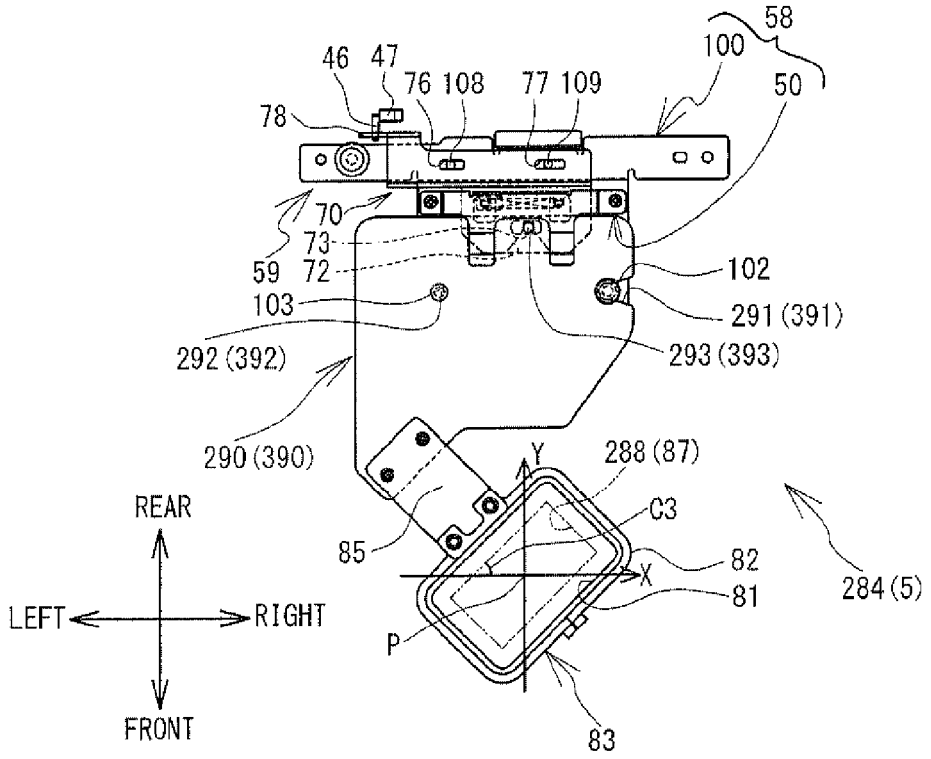
FIG. 5 is a plan view of an embroidery frame 284 that can be mounted on the multi-needle sewing machine 1.
Figure 6:
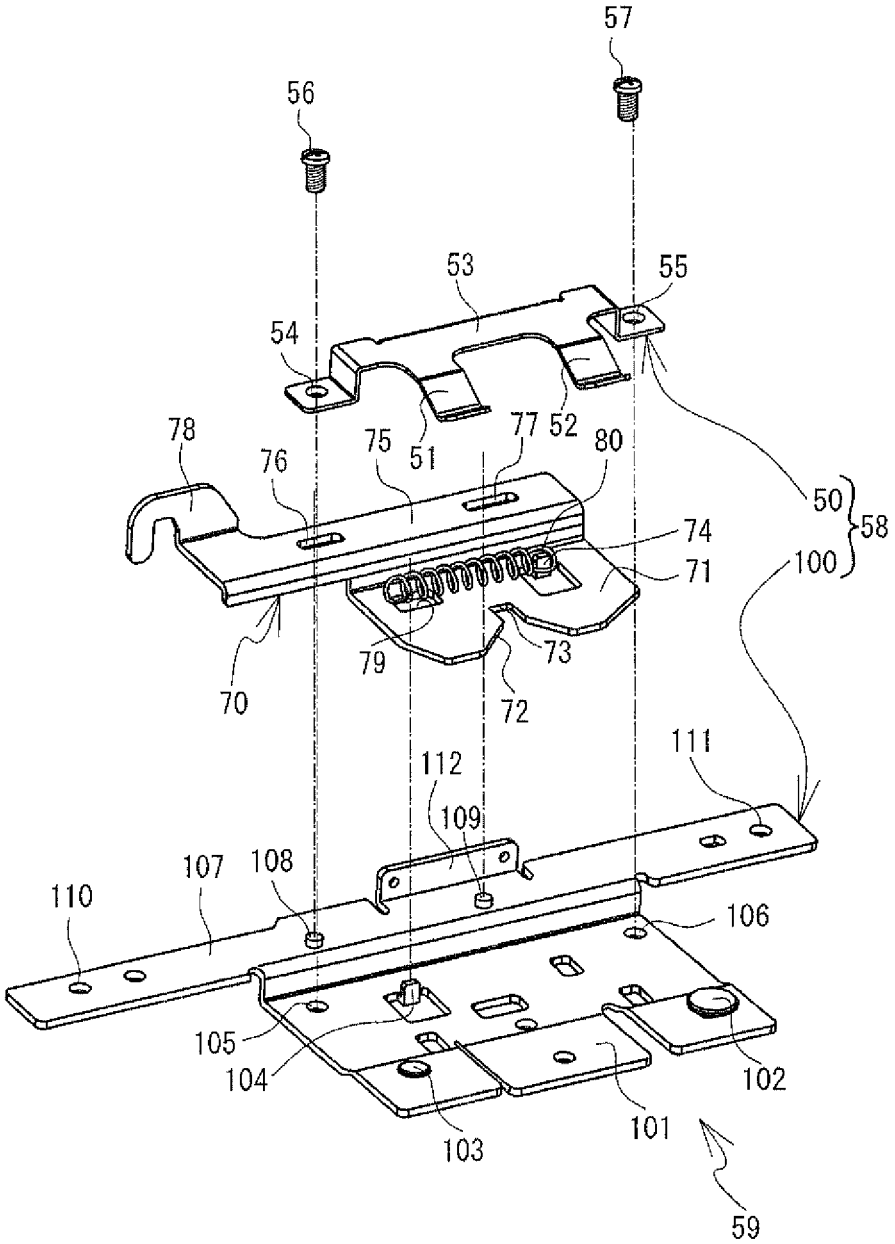
FIG. 6 is an exploded perspective view of the frame mounting mechanism 59.

The inclination (an angle C3) of the holding portion 83 of the embroidery frame 284 shown in FIG. 5 is −45 degrees. The embroidery frame 284 has the holding portion 83, the connecting portion 85 and the mounting portion 290. The holding portion 83 and the connecting portion 85 of the embroidery frame 284 are the same as the holding portion 83 and the connecting portion 85 of the embroidery frame 84. The mounting portion 290 is a plate member that extends in the horizontal direction. The shape of the mounting portion 290 is different from the shape of the mounting portion 90 and also different from the shape of the mounting portion 190. The mounting portion 290 is formed such that a left front portion of the mounting portion 290 protrudes further toward the front than a left front portion of the mounting portion 90. The connecting portion 85 connects the central portion of the one of the long sides of the outer frame 82 and the left front portion of the mounting portion 290, and the inclination of the holding portion 83 is set to −45 degrees. The mounting portion 290 is provided with an engagement portion 291, a through hole 292 and a pressing portion 293. The engagement portion 291 is a cutout that is provided in a central portion of the right side (that extends in the front-rear direction) of the mounting portion 290, and is configured to be engaged with the engagement portion 102 of the main body 100 that will be described later. The through hole 292 is a circular hole that is provided in a central portion on the left side of the mounting portion 290, and is configured to be engaged with the engagement portion 103 of the main body 100. The pressing portion 293 has a pin shape that protrudes downward. The position of the pressing portion 293 with respect to the engagement portion 291 is set to a position that is specific to the embroidery frame 284 in order to distinguish between the embroidery frame 284 and the other embroidery frames 5.

Hereinafter, when the mounting portions 90, 190 and 290 are collectively referred to, they are referred to as mounting portions 390. When any one of the mounting portions 90, 190 and 290 is referred to without being particularly identified, it is referred to as a mounting portion 390. When the engagement portions 91, 191 and 291 are collectively referred to, they are referred to as engagement portions 391. When any one of the engagement portions 91, 191 and 291 is referred to without being particularly identified, it is referred to as an engagement portion 391. When the through holes 92, 192 and 292 are collectively referred to, they are referred to as through holes 392. When any one of the through holes 92, 192 and 292 is referred to without being particularly identified, it is referred to as a through hole 392. When the pressing portions 93, 193 and 293 are collectively referred to, they are referred to as pressing portions 393. When any one of the pressing portions 93, 193 and 293 is referred to without being particularly identified, it is referred to as a pressing portion 393. Based on the inclination of the holding portion 83, the embroidery frames 84, 184 and 284 are also referred to as a 0 degree frame, a 45 degree frame and a −45 degree frame, respectively.

The frame mounting mechanism 59 will be explained with reference to FIGS. 2 to 6. The frame mounting mechanism 59 is a mechanism configured to detachably mount a selected one of the plurality of types of the embroidery frames 5 on the sewing machine 1. The frame mounting mechanism 59 is configured to detect the type of the embroidery frame 5 that is mounted on the sewing machine 1. The frame mounting mechanism 59 mainly includes the frame support portion 58 and a switching plate 70.

The mounting portion 390 of the embroidery frame 5 that is configured to hold the sewing workpiece is configured to be detachably mounted on the frame support portion 58. A selected one of the embroidery frames 84, 184 and 284 can be mounted on the frame support portion 58. In each of the embroidery frames 184 and 284, the long side direction of the rectangular holding portion 83 is inclined by a predetermined angle with respect to the extension direction of the frame support portion 58.

The frame support portion 58 mainly includes the main body 100 and a frame retainer plate 50. The main body 100 is a plate member that extends in the left-right direction, and has a support plate portion 101, a mounting plate portion 107 and a guide plate portion 112. The support plate portion 101 is a plate-like portion that extends in the horizontal direction on the front side of the main body 100. The support plate portion 101 is provided with the engagement portions 102 and 103, a support portion 104 and screw holes 105 and 106. Each of the engagement portions 102 and 103 is a convex portion that protrudes upward and has a circular shape in a plan view. The engagement portions 102 and 103 are configured to be respectively engaged with the engagement portion 391 and the through hole 392 that are provided in the embroidery frame 5. The support portion 104 is a portion that protrudes upward from the top surface of the support plate portion 101. The support portion 104 is inserted through a through hole 79 of the switching plate 70, and is configured to support the left end of an urging member 80. The urging member 80 of the present embodiment is a coil spring. The right end of the urging member 80 is supported by the switching plate 70 that will be described later. The screw holes 105 and 106 are respectively engaged with screws 56 and 57 that are used to fix the frame retainer plate 50 to the main body 100.

The mounting plate portion 107 is a plate-like portion that extends in the left-right direction. The mounting plate portion 107 is a portion that is configured to fix the frame mounting mechanism 59 to the holder 24 of the X carriage 26, and that is configured to guide the movement of the switching plate 70. The mounting plate portion 107 is provided with a pair of left and right guide pins 108 and 109 and screw holes 110 and 111. The guide pins 108 and 109 protrude upward from the top surface of the mounting plate portion 107. The guide pins 108 and 109 are respectively inserted through elongated holes 76 and 77 of the switching plate 70, and are configured to regulate the movement direction of the switching plate 70 together with the elongated holes 76 and 77. The screw holes 110 and 111 are engaged with screws (not shown in the drawings) that are used to fix the frame mounting mechanism 59 to the holder 24. The guide plate portion 112 is a plate-like portion that extends upward from a central portion of the rear edge of the mounting plate portion 107, and is configured to regulate the movement direction of the switching plate 70.

The frame retainer plate 50 is a member that is configured to hold down the mounting portion 390 of the embroidery frame 5 mounted on the frame mounting mechanism 59, from above. The frame retainer plate 50 is provided with a pair of left and right retaining portions 51 and 52, a main body 53 and a pair of left and right screw holes 54 and 55. The retaining portions 51 and 52 extend to the front from the main body 53, and are configured to hold down the mounting portion 390 of the embroidery frame 5 mounted on the frame mounting mechanism 59, from above. The frame retainer plate 50 is fixed to the main body 100 by the screws 56 and 57 that are inserted through the screw holes 54 and 55, respectively.

The switching plate 70 is a movable member that is configured to move in a first direction in conjunction with an operation to mount the mounting portion 390 of the embroidery frame 5 on the frame support portion 58. The amount of movement of the switching plate 70 is set corresponding to the type of the embroidery frame 5. The first direction of the present embodiment is the rightward direction. The switching plate 70 has a first plate portion 71, a second plate portion 75 and an engagement portion 78.

The first plate portion 71 is a plate-like portion that extends in the horizontal direction on the front side of the switching plate 70. The first plate portion 71 is disposed above the support plate portion 101 of the main body 100 and below the frame retainer plate 50. The first plate portion 71 has a first contact portion 72, a second contact portion 73, a support portion 74 and the through hole 79. The first contact portion 72 is a large inverted V-shaped cut out portion formed on the front edge of the first plate portion 71 in a plan view. The first contact portion 72 is configured to guide the pressing portion 393 of the embroidery frame 5 to the second contact portion 73. The second contact portion 73 is a portion that is configured to come into contact with and holds the pressing portion 393 of the embroidery frame 5 when the embroidery frame 5 is mounted on the sewing machine 1. The second contact portion 73 forms a concave portion that is slightly larger than the diameter of the pin-shaped pressing portion 393. The support portion 74 is a portion that protrudes upward from the top surface of the first plate portion 71, and is configured to support the right end of the urging member 80. The switching plate 70 is urged by the urging member 80 in a second direction that is a direction opposite to the first direction. In the present embodiment, the first direction is the rightward direction and the second direction is the leftward direction.

The second plate portion 75 is a plate-like portion that extends in the left-right direction, and is provided with the pair of left and right elongated holes 76 and 77. The elongated holes 76 and 77 each extend in the left-right direction. The guide pins 108 and 109 are inserted through the elongated holes 76 and 77, respectively. The engagement portion 78 is a portion that has a hook-like shape and that extends upward from the left rear end of the second plate portion 75. The engagement portion 78 is configured to be engaged with a detecting element 46 of a detector 47. The detector 47 is a rotary potentiometer. The detecting element 46 rotates corresponding to the amount of movement of the switching plate 70. Therefore, the detector 47 can detect the amount of movement of the switching plate 70 based on the amount of rotation of the detecting element 46.

Figure 7:
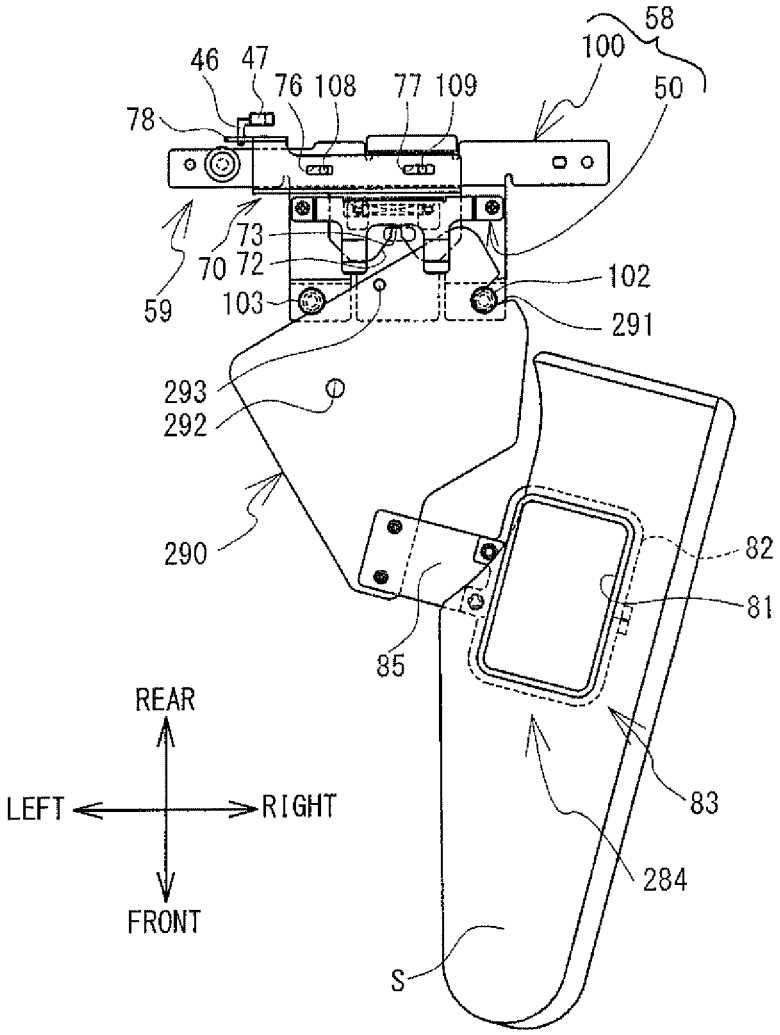
FIG. 7 is a plan view showing a process of mounting the embroidery frame 284, which holds a shoe S, on a frame support portion 58 of the multi-needle sewing machine 1.
Figure 8:
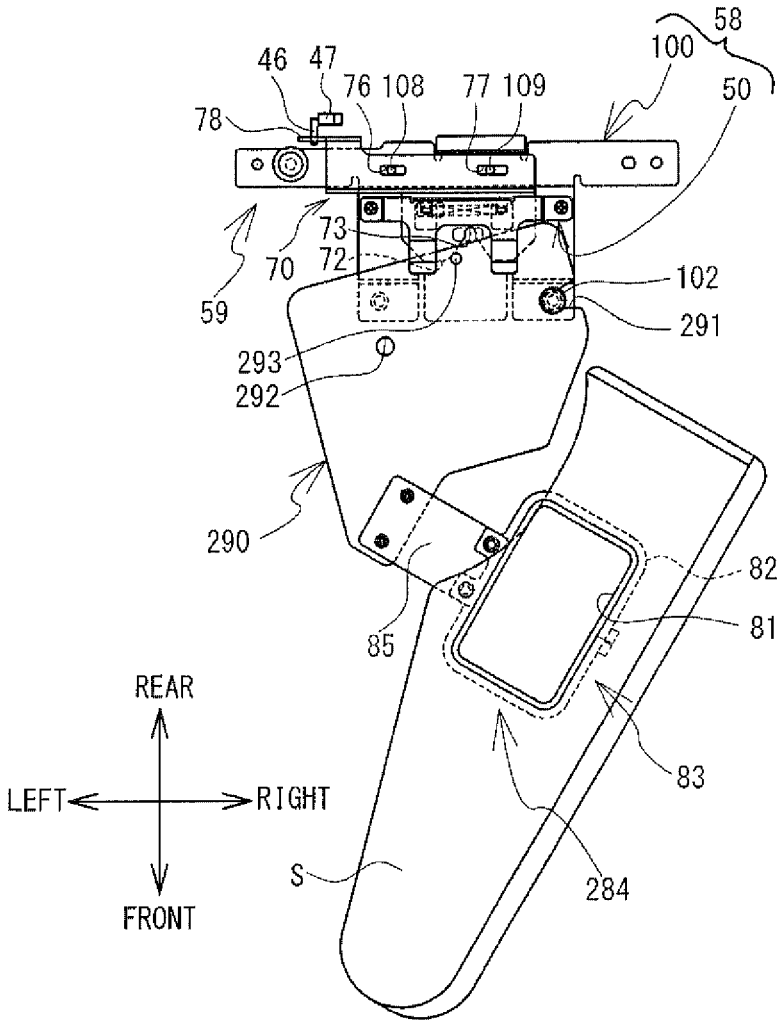
FIG. 8 is a plan view showing a process of mounting the embroidery frame 284, which holds the shoe S, on the frame support portion 58 of the multi-needle sewing machine 1.

Operations to mount the embroidery frame 5 on the sewing machine 1 will be explained. As an example, a case will be explained in which the embroidery frame 284 is mounted on the frame support portion 58 in a state in which the holding portion 83 holds a side surface of the shoe S such that the long sides of the holding portion 83 are substantially in parallel with a shoe bottom or a shoe opening of the shoe S, which is the sewing workpiece. As shown in FIG. 7, first, the user may engage the engagement portion 102 of the main body 100 with the engagement portion 291 provided on the mounting portion 290 of the embroidery frame 284. At this time, the side that is on the rear side of the mounting portion 290 is inclined with respect to the extension direction (left-right direction) of the frame support portion 58. In a state in which the engagement portion 102 is engaged with the engagement portion 291, the user may rotate the embroidery frame 284 in the clockwise direction in a plan view around the engagement portion 102. As a result, as shown in FIG. 8, the pressing portion 293 of the mounting portion 290 comes into contact with the first contact portion 72, and moves toward the second contact portion 73 while being guided by the first contact portion 72. The pressing portion 293 comes into contact with the first contact portion 72 while pressing the first contact portion 72. The switching plate 70 moves in the first direction when the first contact portion 72 is pressed in the first direction by the pressing portion 293 against the urging force of the urging member 80. The amount of movement of the switching plate 70 is determined in accordance with the position of the pressing portion 293 with respect to the engagement portion 291.

Figure 9:
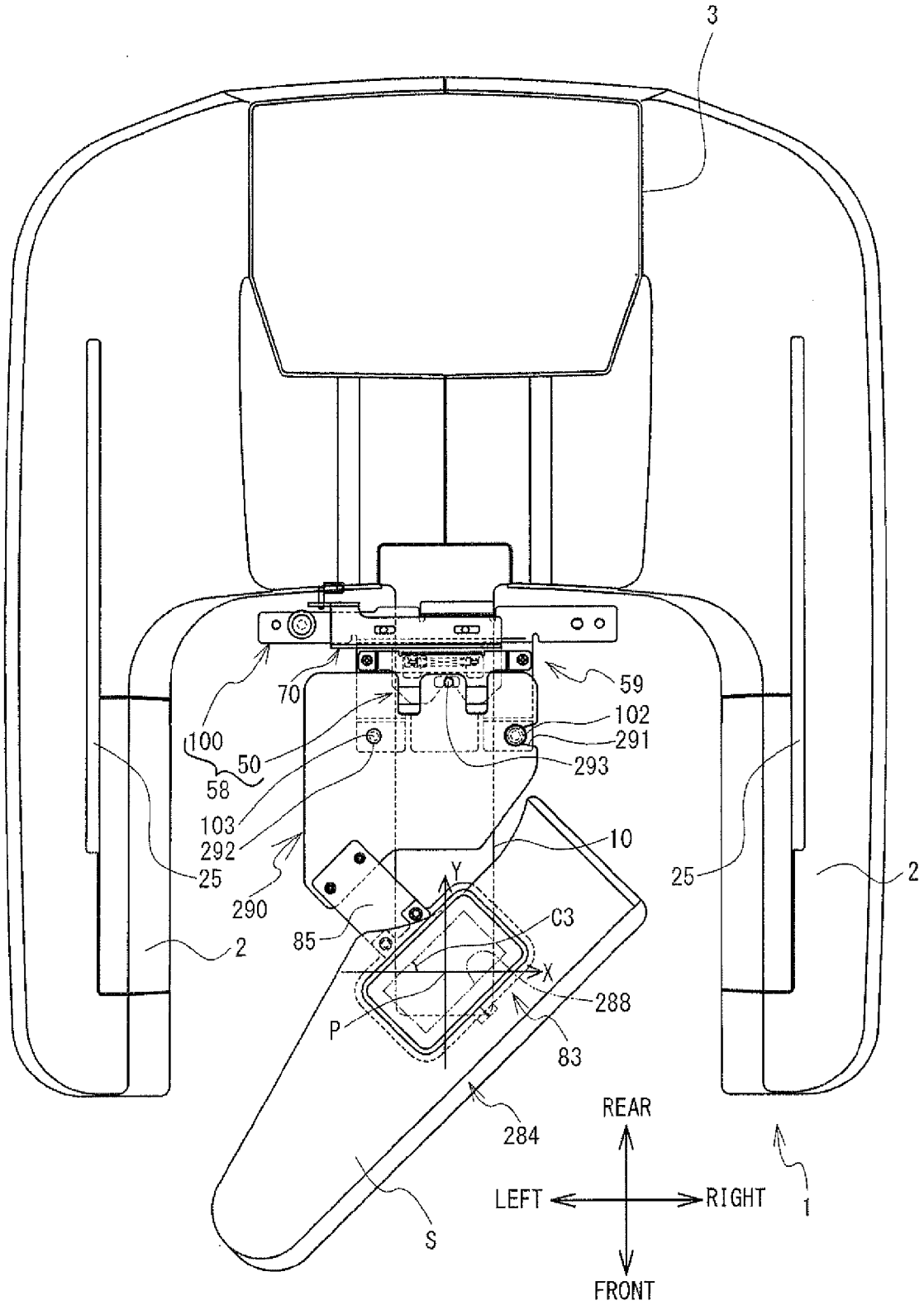
FIG. 9 is a plan view showing a positional relationship between the shoe S and support portions 2 in a state in which the embroidery frame 284 that holds the shoe S is mounted on the frame support portion 58 of the multi-needle sewing machine 1.

When the user further rotates the embroidery frame 284 in the clockwise direction in a plan view, the pressing portion 293 is guided by the first contact portion 72 to the second contact portion 73, and is accommodated in the second contact portion 73. When the user further rotates the embroidery frame 284 in the clockwise direction in a plan view, the through hole 292 and the engagement portion 103 engage with each other, as shown in FIG. 9. Thus, the rotation of the embroidery frame 284 is regulated and the position of the embroidery frame 284 in the horizontal direction is fixed. At this time, the side that is on the rear side of the mounting portion 290 is parallel to the extension direction of the frame support portion 58. The mounting portion 290 is held down from above by the frame retainer plate 50, and is clamped by the frame retainer plate 50 and the main body 100. As a result, the position of the mounting portion 290 in the up-down direction is fixed. With the above-described operations, the embroidery frame 284 is mounted on the sewing machine 1. When the embroidery frame 284 is removed from the sewing machine 1, operations opposite to those described above are performed. As shown in FIG. 9, when the embroidery frame 284 is mounted on the frame mounting mechanism 59, the shoe bottom of the shoe S is arranged to be inclined with respect to the extension direction of the frame support portion 58, and the shoe S is arranged between the pair of left and right support portions 2.

Figure 10:
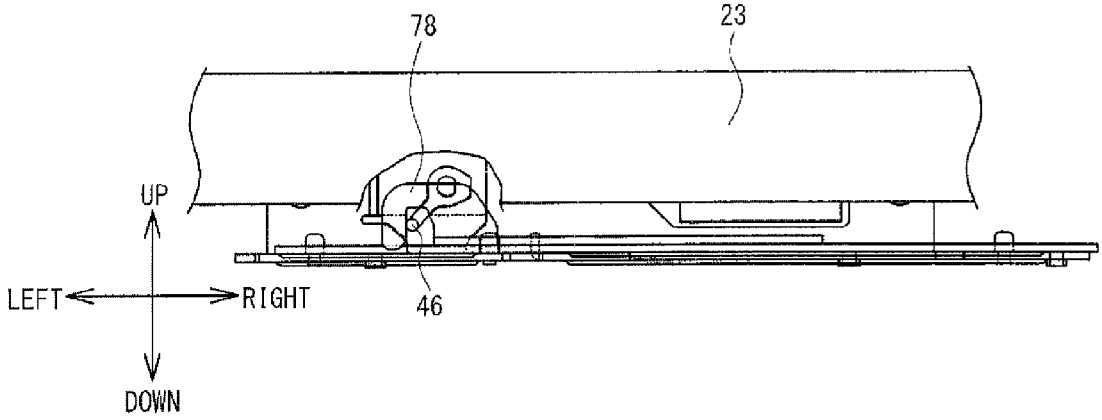
FIG. 10 is an explanatory view of a position of a detecting element 46 of a detector 47 in a state in which the embroidery frame 84 is mounted on the frame support portion 58 of the multi-needle sewing machine 1.
Figure 11:
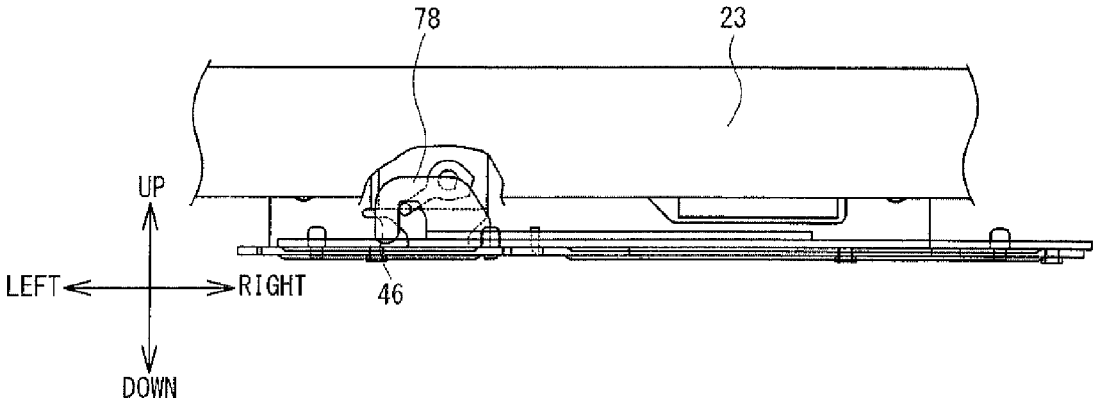
FIG. 11 is an explanatory view of a position of the detecting element 46 of the detector 47 in a state in which the embroidery frame 184 is mounted on the frame support portion 58 of the multi-needle sewing machine 1.
Figure 12:
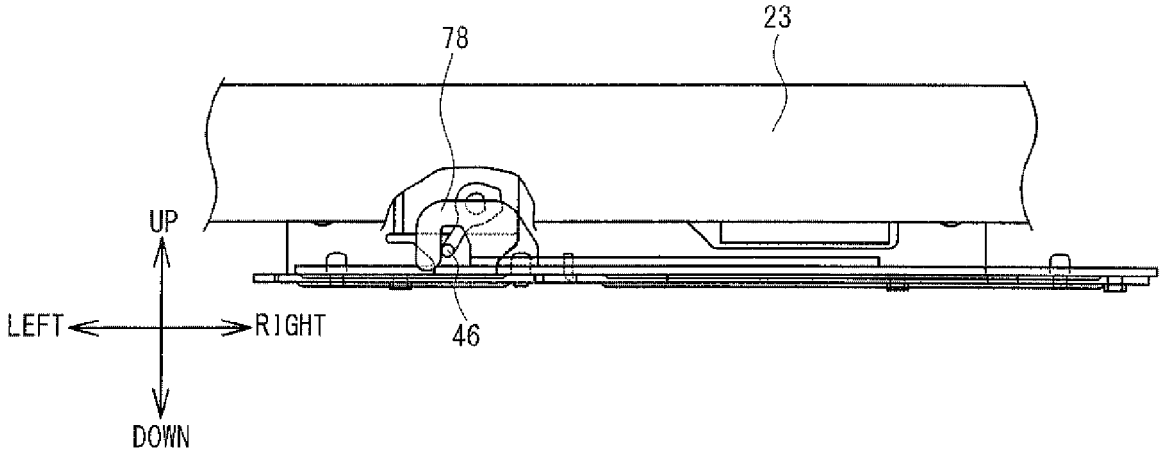
FIG. 12 is an explanatory view of a position of the detecting element 46 of the detector 47 in a state in which the embroidery frame 284 is mounted on the frame support portion 58 of the multi-needle sewing machine 1.

A method for detecting the type of the embroidery frame 5 will be explained. In the mounting portion 390 of the embroidery frame 5 of the present embodiment, the position of the pressing portion 393 with respect to the engagement portion 391 differs in accordance with the type of the embroidery frame 5. Therefore, the amount of movement of the switching plate 70 in the first direction varies in accordance with the position of the pressing portion 393 with respect to the engagement portion 391. The engagement portion 78 of the switching plate 70 is engaged with the detecting element 46 of the detector 47. When the switching plate 70 moves, the detecting element 46 rotates. As shown in FIGS. 10 to 12, the amount of rotation of the detecting element 46 is different depending on whether the embroidery frame 84 is mounted on the sewing machine 1, whether the embroidery frame 184 is mounted on the sewing machine 1, or whether the embroidery frame 284 is mounted on the sewing machine 1. Specifically, the amount of rotation becomes larger in the order of the amount of rotation of the embroidery frame 284 (the −45 degree frame) shown in FIG. 12, the amount of rotation of the embroidery frame 84 (the 0 degree frame) shown in FIG. 10, and the amount of rotation of the embroidery frame 184 (the 45 degree frame) shown in FIG. 11. The detector 47 can detect the type of the embroidery frame 5 by detecting the amount of rotation of the detecting element 46.

Figure 13:
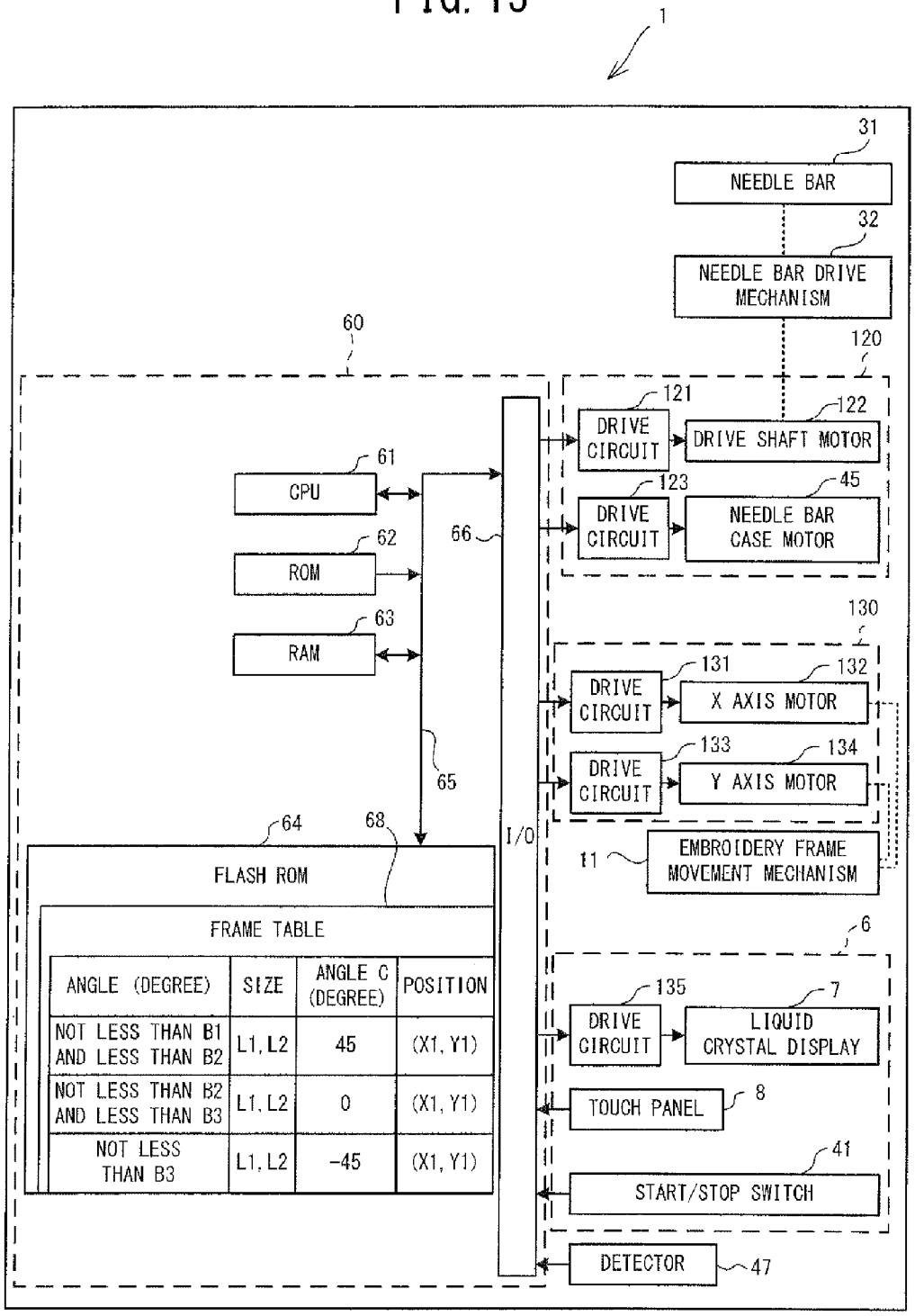
FIG. 13 is a block diagram showing an electrical configuration of the multi-needle sewing machine 1.

An electrical configuration of the sewing machine 1 will be explained with reference to FIG. 13. As shown in FIG. 13, the sewing machine 1 is provided with a needle drive portion 120, a sewing target drive portion 130, the operation portion 6, a control portion 60 and the detector 47.

The needle drive portion 120 is provided with a drive shaft motor 122, a drive circuit 121, a needle bar case motor 45, and a drive circuit 123. The drive shaft motor 122 causes the needle bar 31 to move in the up-down direction. The drive circuit 121 may drive the drive shaft motor 122 in accordance with a control signal from the control portion 60. The needle bar case motor 45 causes the needle bar case 21 to move in the left-right direction. The drive circuit 123 may drive the needle bar case motor 45 in accordance with a control signal from the control portion 60.

The sewing target drive portion 130 is provided with the X-axis motor 132, a drive circuits 131, the Y-axis motor 134, and a drive circuits 133. The X-axis motor 132 may drive the embroidery frame movement mechanism 11 and thereby causes the embroidery frame 5 (refer to FIG. 2) to move in the left-right direction. The drive circuit 131 may drive the X-axis motor 132 in accordance with a control signal from the control portion 60. The Y-axis motor 134 may drive the embroidery frame movement mechanism 11 and thereby causes the embroidery frame 5 to move in the front-rear direction. The drive circuit 133 may drive the Y-axis motor 134 in accordance with a control signal from the control portion 60.

The operation portion 6 is provided with the touch panel 8, a drive circuit 135, the LCD 7 and the start/stop switch 41. The drive circuit 135 may drive the LCD 7 in accordance with a control signal from the control portion 60.

The control portion 60 is provided with the CPU 61, a ROM 62, a RAM 63, a flash ROM 64 and an input/output (I/O) interface 66, and they are mutually connected by a signal line 65. The needle drive portion 120, the sewing target drive portion 130, the operation portion 6 and the detector 47 are respectively connected to the I/O interface 66.

The CPU 61 performs main control of the sewing machine 1. The CPU 61 performs various operations and processing that relate to sewing, in accordance with various programs stored in a program storage area (not shown in the drawings) of the ROM 62. Although not shown in the drawings, the ROM 62 is provided with a plurality of storage areas including the program storage area and a pattern storage area. Various programs to operate the sewing machine 1, including a main program, are stored in the program storage area. The main program is a program to perform main processing. In the main processing, processing is performed in which a sewing area 87 is set inside the inner frame 81 corresponding to the type of the embroidery frame 5 that has been mounted on the frame support portion 58. In the main processing, processing is further performed in which the pattern selected by the user is arranged in accordance with settings of the sewing area 87 and sewing is performed on the sewing workpiece held by the embroidery frame 5. The RAM 63 includes, as necessary, a storage area to store operation results etc. processed by the CPU 61. The flash ROM 64 stores various parameters including a frame table 68 that are used for the sewing machine 1 to perform various types of processing.

The frame table 68 stores corresponding relationships between the angle (degree) of the detecting element 46 shown by an output result of the detector 47 and the settings of the sewing area 87 that corresponds to the type of the embroidery frame 5. That is, the frame table 68 stores information about the size, the position and the angle of the sewing area 87, for each of the types of the embroidery frames 5. The settings of the sewing area 87 that corresponds to the type of the embroidery frame 5 of the present embodiment include the size of the sewing area 87, the angle (degree) of the sewing area 87 in the long side direction with respect to the extension direction of the frame support portion 58, and the position of the sewing area 87 with respect to the frame support portion 58. The sewing area 87 is an area which is set inside the inner frame 81 and in which stitches can be formed. The sewing area 87 of the present embodiment has a rectangular shape, and the size of the sewing area 87 is represented by the length of the shorter sides and the length of the longer sides. The angle (degree) of the sewing area 87 in the long side direction with respect to the extension direction of the frame support portion 58 is set to match the angle (degree) of the holding portion 83 in the long side direction with respect to the extension direction of the frame support portion 58. The position of the sewing area 87 with respect to the frame support portion 58 is represented by the amount of movement of the embroidery frame 5 when the needle drop point is set to the position of the center point of the sewing area 87. The CPU 61 performs the main processing based on the output result of the detector 47 and the frame table 68. Through the main processing, a sewing area 88 shown in FIG. 3 is set inside the embroidery frame 84. A sewing area 188 shown in FIG. 4 is set inside the embroidery frame 184. A sewing area 288 shown in FIG. 5 is set inside the embroidery frame 284. As shown in FIGS. 3 to 5, an origin P of the embroidery coordinate system is set to the center point of the sewing area 87.

Operations of the sewing machine 1 that forms stitches on a sewing workpiece (a shoe, or a tubular or sheet-like work cloth, for example) held by the embroidery frame 5 will be explained. The embroidery frame 5 that holds the sewing workpiece is supported by the Y carriage 23. One of the ten needle bars 31 is selected by the needle bar case 21 moving in the left-right direction. The embroidery frame movement mechanism 11 moves the embroidery frame 5 to a predetermined position. When a drive shaft (not shown in the drawings) is rotated and driven by the drive shaft motor 122, the needle bar drive mechanism 32 and a thread take-up lever drive mechanism (not shown in the drawings) are driven. As a result, the needle bar drive mechanism 32 and the thread take-up lever drive mechanism are driven, and the needle bar 31 located in the sewing position and the thread take-up lever 19 corresponding to the needle bar 31 are driven to move in the up-down direction. The shuttle drive mechanism (not shown in the drawings) is driven by the rotation of the drive shaft motor 122, and the shuttle (not shown in the drawings) is rotated and driven. In this manner, the needle (not shown in the drawings), the thread take-up lever 19 and the shuttle are synchronized and driven, and the stitches are formed on the sewing workpiece.

The embroidery frame 5 has the specific mounting portion 390 that corresponds to the type of the embroidery frame 5. Therefore, when the user mounts the embroidery frame 5 on the sewing machine 1, it is sufficient for the user to simply perform the operation of mounting the embroidery frame 5 on the frame support portion 58. The operation of mounting the embroidery frame 5 on the frame support portion 58 is a simple operation in which the embroidery frame 5 is rotated in the clockwise direction around the engagement portion 102 in a state in which the engagement portion 102 and the engagement portion 391 are engaged with each other. Therefore, the sewing machine 1 can detect the type of the embroidery frame 5 while omitting the user's troublesome operation of moving the position of a movable holder with respect to a frame holder corresponding to the type of the embroidery frame, which is necessary in a known sewing machine. In other words, the sewing machine 1 can detect the type of the embroidery frame 5 and also can simplify the operation to mount the embroidery frame 5.

The sewing machine 1 has the urging member 80. Therefore, when the embroidery frame 5 is not mounted on the sewing machine 1, The sewing machine 1 can automatically arrange the position of the switching plate 70 in the position where the switching plate 70 is to be located when the embroidery frame 5 is not mounted. Thus, with the sewing machine 1, the user can omit the troublesome operation of switching the position of the switching plate 70, which is necessary when the urging member 80 is not provided.

With a relatively simple structure, the sewing machine 1 can move the switching plate 70 in the first direction by the movement amount that corresponds to the type of the embroidery frame 5. With a relatively simple structure, the sewing machine 1 can identify the type of the embroidery frame 5 by converting the movement amount of the switching plate 70 into the rotation amount of the detecting element 46. Therefore, by using the rotary potentiometer used in the known sewing machine, the sewing machine 1 can detect the type of the embroidery frame 5 that has the mounting portion 390 specific to the type of the embroidery frame 5.

The sewing machine according to the present disclosure is not limited to the embodiments described above, and various types of modifications may be made insofar as they are within the scope of the present disclosure. For example, the modifications (A) to (C) described below may be made as desired.

(A) The configuration of the sewing machine 1 may be modified as desired. The sewing machine may also be another type of sewing machine, such as an industrial sewing machine, a home-use sewing machine, or the like, for example.

(B) It is sufficient that the embroidery frame 5 can hold a sewing workpiece and has a specific mounting portion corresponding to the type of the embroidery frame 5, and that the embroidery frame 5 can be mounted on the sewing machine. For example, the holding portion of the embroidery frame 5 may include an upper frame and a lower frame, and may hold the sewing workpiece by clamping the sewing workpiece in the up-down direction. The pressing portion 393 of the embroidery frame 5 may have a shape other than a pin shape. The types and the number of types of the embroidery frames that can be mounted on the sewing machine 1 may be changed as necessary. The type of the embroidery frame may be shown, for example, by the shape and the size of the holding portion and a combination of the position and the angle of the holding portion with respect to the frame support portion. The angle of the holding portion in the long side direction with respect to the extension direction of the frame support portion may be changed as necessary.

(C) The first direction and the second direction may be changed as necessary. The direction in which the detecting element 46 rotates may be changed as necessary. It is sufficient that the urging member urges the movable member in the second direction, and the urging member may be an elastic member, such as a plate spring, instead of the coil spring. It is sufficient that the detector 47 can directly or indirectly detect the movement amount of the switching plate 70 (the movable member), and the detector 47 may be another sensor, such as a position sensor, instead of the rotary potentiometer. The configuration of the movable member and the frame support portion may be changed as necessary. For example, the shape, the size and the material etc. of each of the first engagement portion, the second engagement portion, the third engagement portion, the guide portion, the first support portion and the second support portion may be changed as necessary.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

an embroidery frame configured to hold a sewing workpiece, the embroidery frame including a mounting portion having a specific shape that corresponds to a type of the embroidery frame;

a frame support portion configured to be detachably mounted with the mounting portion of the embroidery frame;

a moving device configured to move the frame support portion;

a movable member configured to move in a first direction by a movement amount corresponding to the type of the embroidery frame, in conjunction with an operation in which the mounting portion of the embroidery frame is mounted on the frame support portion;

a detecting device configured to detect the movement amount of the movable member, and to detect the type of the embroidery frame mounted on the frame support portion based on the detected movement amount; and an urging member configured to urge the movable member in a second direction, the second direction being a direction opposite to the first direction, wherein the movable member includes a contact portion configured to come into contact with a pressing portion provided in the mounting portion of the embroidery frame when the embroidery frame is mounted on the frame support portion; and the movable member is configured to move in the first direction when the contact portion is pressed in the first direction by the pressing portion against an urging force of the urging member, in conjunction with the operation in which the mounting portion of the embroidery frame is mounted on the frame support portion.

2. The sewing machine according to claim 1, wherein the detecting device is a rotary potentiometer that has a detecting element configured to come into contact with the movable member and rotate corresponding to the movement amount of the movable member.

3. The sewing machine according to claim 1, wherein the detecting device is a rotary potentiometer that has an detecting element configured to come into contact with the movable member and rotate corresponding to the movement amount of the movable member;

the frame support portion includes:

a first engagement portion configured to be engaged with a second engagement portion provided in the mounting portion of the embroidery frame;

a guide portion configured to guide the movement of the movable member in the first direction and the second direction; and a first support portion configured to support one end of the urging member;

the contact portion is configured to come into contact with the pressing portion while being pressed by the pressing portion when the embroidery frame is rotated in a predetermined direction in a state in which the first engagement portion is engaged with the second engagement portion of the embroidery frame, the pressing portion having a pin shape and being arranged in a position with respect to the first engagement portion in the mounting portion corresponding to the type of the embroidery frame; and the movable member includes:

a third engagement portion configured to be engaged with the detecting element; and a second support portion configured to support another end of the urging member.

* * * * *